US008360673B2

(12) United States Patent
Dwyer

(10) Patent No.: US 8,360,673 B2
(45) **Date of Patent: *Jan. 29, 2013**

(54) DUAL-RESERVOIR MASCARA APPLICATOR WITH DISPERSIVE PRODUCT DELIVERY

(76) Inventor: Walter Dwyer, Port Washington, NY (US)

( * ) Notice: Subject to any disclaimer, the term of this patent is extended or adjusted under 35 U.S.C. 154(b) by 105 days.

This patent is subject to a terminal disclaimer.

(21) Appl. No.: 12/925,164

(22) Filed: Oct. 14, 2010

(65) Prior Publication Data

US 2011/0170935 A1 Jul. 14, 2011

Related U.S. Application Data

(60) Provisional application No. 61/279,008, filed on Oct. 14, 2009.

(51) Int. Cl.
*A46B 11/04* (2006.01)
*A47L 13/22* (2006.01)

(52) U.S. Cl. ..... 401/278; 401/279

(58) Field of Classification Search ..... 401/28, 401/151, 171, 172, 174, 188 R, 262, 263, 401/265, 266, 268–270, 277–279, 282, 284, 401/286, 287, 289, 290
See application file for complete search history.

(56) References Cited

U.S. PATENT DOCUMENTS

| | | | | |
|---|---|---|---|---|
| 4,543,913 | A * | 10/1985 | Wilkeson | 401/28 |
| 4,674,904 | A * | 6/1987 | Buck | 401/268 |
| 4,764,044 | A * | 8/1988 | Konose | 401/278 |
| 4,902,154 | A * | 2/1990 | Valenza | 401/268 |
| 6,745,781 | B2 * | 6/2004 | Gueret | 401/266 |
| 7,309,185 | B2 * | 12/2007 | Thorpe et al. | 401/277 |

* cited by examiner

*Primary Examiner* — Tuan N Nguyen
(74) *Attorney, Agent, or Firm* — Thomas A. O'Rourke; Bodner & O'Rourke, LLP

(57) ABSTRACT

An applicator device, particularly suited for mascara, may deliver high or low viscosity liquids or semi-liquids, and contains a valve controlling flow between a product reservoir, an intermediate pooling area, and a product dispensing chamber. The arrangement prevents backflow to the product reservoir, precluding contamination of the product supply. Product delivery from the product dispensing chamber is from one of several methods. In one method, a plurality of prongs each comprise a conduit to the product dispensing chamber and thereby allow for dispersed product delivery from the prong tips. Alternatively, there may be one or more openings on the applicator head being interconnected to the dispensing chamber, which permits product to extrude between the rows of prongs and thereby be applied to a receiving surface. A third embodiment combines the two methods along with alternating height prongs to more effectively apply mascara onto all sides of a user's lashes.

19 Claims, 12 Drawing Sheets

DUAL-RESERVOIR MASCARA APPLICATOR WITH DISPERSIVE PRODUCT DELIVERY

CROSS REFERENCES TO RELATED APPLICATIONS

This application claims priority on U.S. Provisional Application Ser. No. 61/279,008, filed on Oct. 14, 2009 having the title, "Applicator Device with Dispersive Product Delivery," the disclosures of which are incorporated herein by reference.

FIELD OF THE INVENTION

The present invention relates to improvements in apparatus used for the application of liquids, creams, gels and the like, and more particularly to apparatus which comprise a valved dual reservoir system, and are capable of providing a careful delivery system of products, particularly for mascara.

BACKGROUND OF THE INVENTION

There are many instances today, both in ordinary home use as well as in commercial or industrial environments, where there is a need to have a means of applying liquids, creams, ointments, lotions, gels, oils, paste, and the like, to a surface. Where such applications may be made in generous quantities across a large surface area, there is little need for a delivery system that provides careful control of the product being dispensed. Conversely, where the product needs to be dispensed with care due to the delicacy of the receiving surface, or where product needs to be applied only in specific locations while excluding adjacent surfaces, or where the high cost of product dictates the minimization of waste, the means and method of application acquire increasing importance.

Examples of the instances where such diligence is required in the application of a product are diverse, and may include the following: application of off-the-shelf skin creams or moisturizing lotions; ointments for treatment of dermatological conditions, burn treatment medicines, anti-bacterial treatment for cuts; scalp treatments; hair coloring; painting; applications of wood stain; dispensing glue; applying of shoe polish; decorating a cake; or applying mascara or other make-up.

Common methods of applying a liquid-like product unusually involve either use of a sponge or a brush that is used in combination with a storage container. One example is shown by U.S. Pat. No. 6,010,268 to Sereg. The Sereg patent describes a handle component that "is first filled with the liquid composition and then inverted and squeezed to force the liquid into the sponge component," and that "as the sponge surface is wiped over the surface and the liquid retained therein becomes depleted, the handle is periodically squeezed to dispense more of the liquid as it is needed." But the sponge of the Sereg patent does not lend itself very well to either careful control of the amounts of fluid dispensed to the sponge, above that which is achievable by a hand squeeze, or lend itself to the diligent application of product only to specific areas.

Another example is shown by U.S. Pat. No. 7,309,185 to Thorpe, which discloses a pen-type applicator, where a handle may be twisted so that a mechanical means causes a piston to translate and force material contained in a storage space to extrude out of an opening. The opening may provide material flow onto either a smooth applicator surface or one containing bristles that form a toothbrush. Although the Thorpe device offers a means of relative control over the quantity of product being delivered, it nonetheless provides a very course means of delivering the product to specific areas. As seen in FIG. 8, the device requires extrusion of product quantities sufficient to overhang the immediate bristles, but then relies on the generous quantity and subsequent contact with the receiving surface to achieve distribution to bristles on the periphery. The device is not tailored to independently direct the product with any precision to a specified surface, which may not be necessary for brushing ones teeth, but may be necessary for many other applications. The Thorpe device is also not adapted to accommodate the flow of materials having lower viscosities.

The applicator of U.S. Pat. No. 5,156,479 to Iizuka exhibits qualities more conducive to precise delivery of a specified quantity of product. The Iizuka device similarly has an opening through which the product is delivered, but the opening is at the end of an axial tube which forms the core of a cosmetic applicator brush. The applicator brush of Iizuka is not described in any detail, but similarly appears in each of the Figures as a pointed brush resembling an artist's script-type brush. The arrangement would permit pinpoint application of product, and the seemingly dense aggregation of bristles surrounding the axial tube could accommodate lower viscosity products better than the Thorpe device. However, the Iizuka applicator is limited to such pinpoint applications or linework, and would be very inefficient for covering larger surface areas.

The invention shown by U.S. Pat. No. 6,227,737 to Kageyama discloses a similar arrangement. Kageyama has a twist-type handle that translates a piston for delivery of product from an opening, but has for its delivery means a flat-tipped brush, which would be an improvement for delivery to areas other than those resembling simple linework. However, increasing the size of the brush merely provides for a proportional increase in potential coverage for a given stroke, but does not afford the fidelity that may be achieved with the script-type brush of Iizuka. Moreover, the pen arrangements of both Iizuka and Kageyama particularly lend themselves to application of product by a user while grasping and manipulating the device as if it were a writing implement.

The invention disclosed herein solves all of these problems found in the prior art using a valve system in a special applicator head, which creates a dual reservoir system, with its functionality being particularly well adapted for use in cosmetics as a mascara applicator.

OBJECTS OF THE INVENTION

It is an object of the invention to provide a means for delivering liquids, creams, gels and the like.

It is another object of the invention to provide a means for carefully controlling quantities of liquid or viscous semi-solid products dispensed onto a receiving surface.

It is a further object of the invention to provide a means of delivering measured quantities of liquid or viscous semi-solid product onto discrete surfaces of an object.

It is another object of the invention to provide a means that is adaptable to delivering liquid or viscous semi-solid product onto discrete surfaces encompassing either a small of large surface area.

It is also an object of the invention to a means that is adaptable to effectively delivering either a low viscosity or high viscosity product.

SUMMARY OF THE INVENTION

An applicator device is comprised of an applicator head and a body. The invention disclosed herein provides for various embodiments of the applicator head, which may snap into the body and provide for dispensing of measured amounts of product to be delivered onto discrete surfaces of an object. Although the applicator device may find use in various different applications, its functionality is particularly well suited for use in the cosmetics industry as a mascara applicator. Its advantageous nature therein arises because typical mascara applicators use a brush disposed on the end of a wiper, which is successively inserted into the mascara bottle to load up product, and consequently causes contamination of the entire bottled product.

The body may generally be comprised of a handle coupled to a piston rod which mates with a piston that is disposed within a cylinder. Installation of the applicator head into an end of the cylinder creates a chamber to serve as a product reservoir. The applicator head may be snapped into the cylinder of the body, which may be accommodated by having one or more annular protrusions on the tubular extension of the applicator head, and corresponding annular indentations on the cylinder's mating internal surface.

The cylinder head may contain a valve arrangement to permit flow of product into a product delivery chamber, but prevent backflow which could cause contamination of the product supply. The product delivery chamber may have a conduit through the flat face of the applicator head by one of two possible means. The flat face may contain a plurality of prongs, each of which has a conduit that connects to the product delivery chamber, so that twisting of the handle forces product through each prong for direct application to the receiving surface. Alternatively, there may be a single conduit between the product delivery chamber and only the flat face of the head, wherein twisting of the handle delivers product to the flat face in a sufficient quantity that it may then be applied by using the prongs like bristles of a brush.

DETAILED DESCRIPTION OF THE INVENTION

Figure 1:
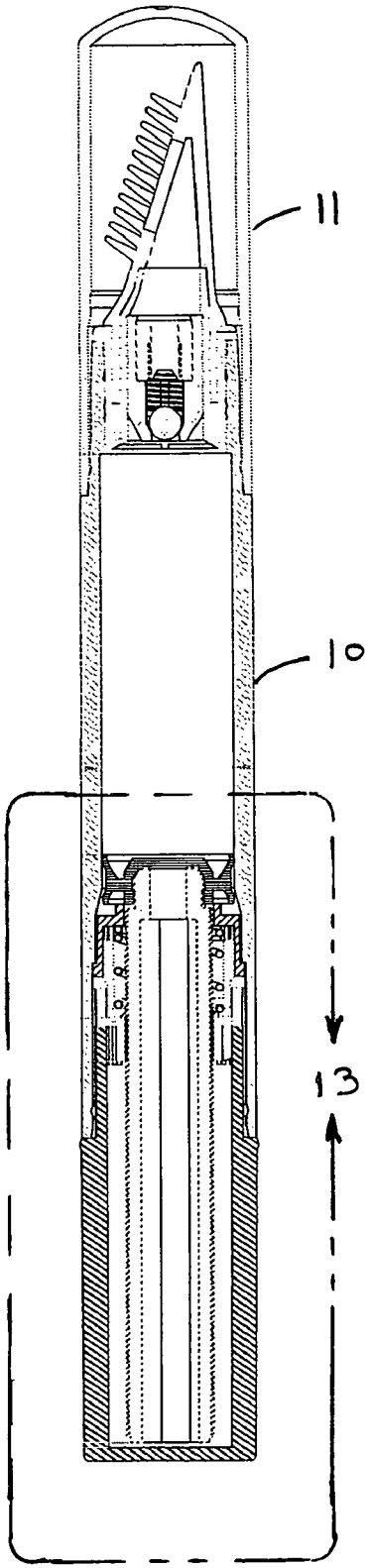
FIG. 1 is a cross-sectional view of a first embodiment of the applicator and cap of the present invention.
Figure 3:
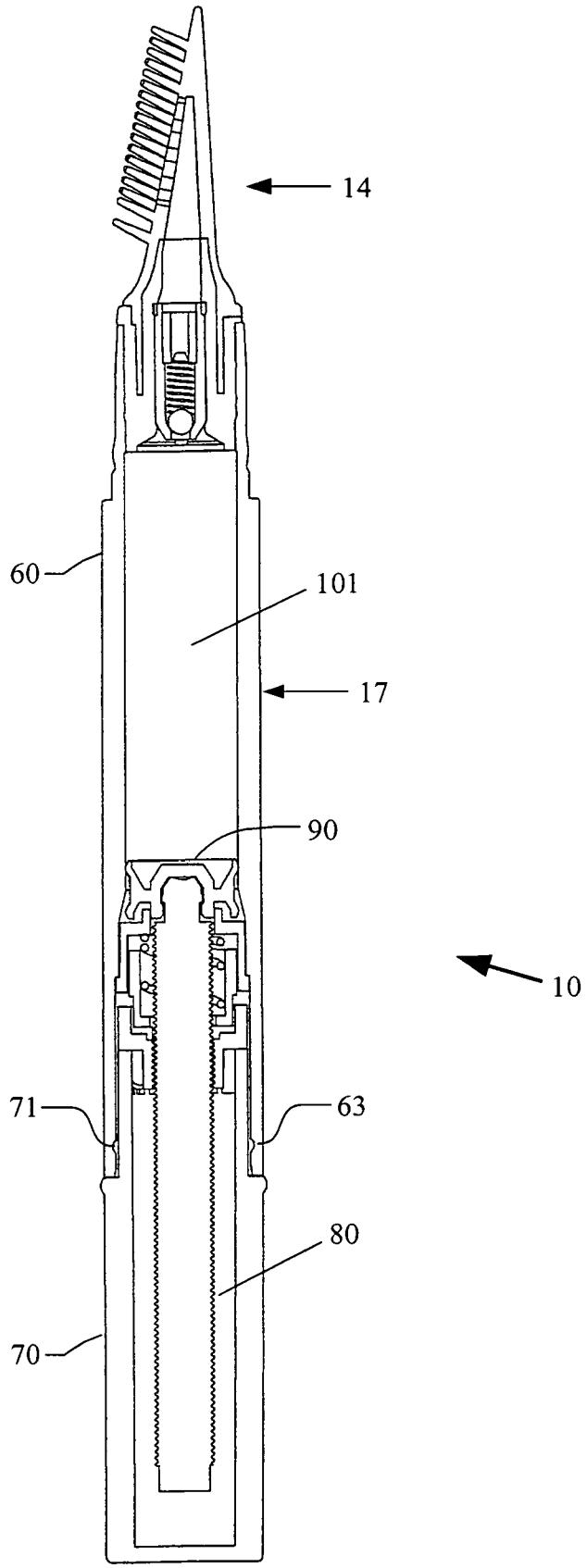
FIG. 3 is a side view of the first embodiment of the applicator of the present invention.
Figure 4:
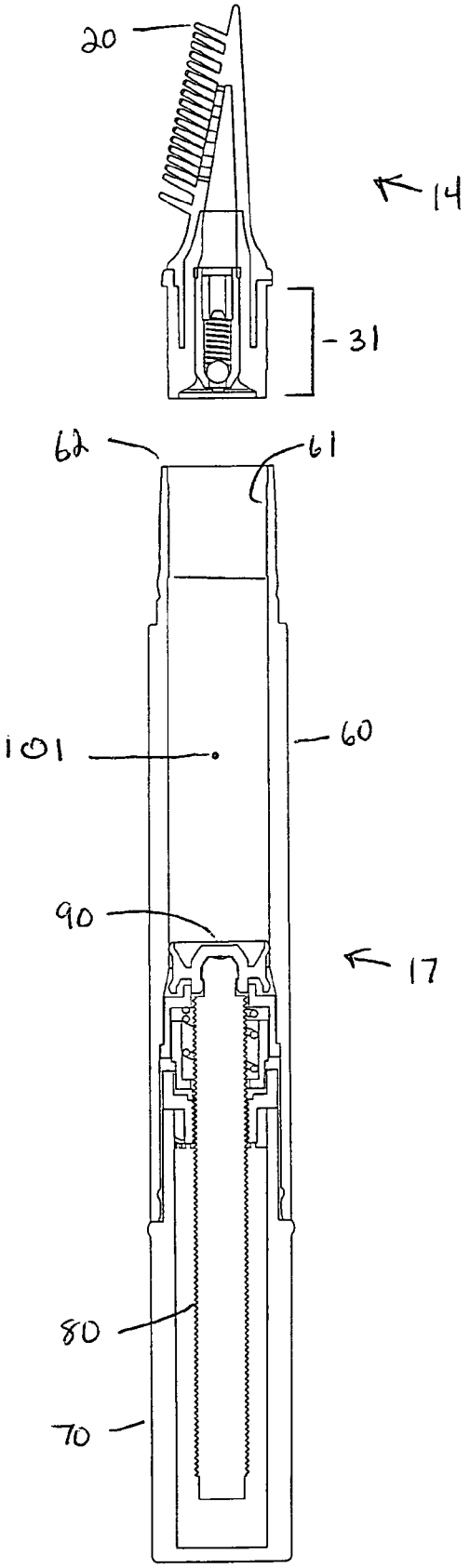
FIG. 4 is an exploded view of the applicator head and body of the first embodiment of the present invention.

FIG. 1 shows a first embodiment of the present invention, which includes an applicator device 10 with a cap 11. Assembly of the applicator device 10 is shown in the cross-sectional view of FIG. 3, and further broken down into its component parts—a body 17 and an applicator head 14—as seen in FIG. 4. The invention disclosed herein provides for various embodiments of the applicator head which may assemble into the body 17 in one of several ways to provide for careful dispensing of amounts of product to be delivered onto discrete surfaces of an object.

The body 17 (FIGS. 3 and 4) may generally be comprised of cylinder 60 that receives a handle 70 so that the handle is free to rotate relative to the cylinder. As seen in FIG. 3, a cylindrical portion of the handle 70 may be received within cylinder 60 and thereby be able to rotate, and may be retained therein by use of an annular protrusion 71 on the handle 70 being received by an annular recess 63 on the cylinder 60. The handle 70 may be threadably coupled to a piston rod 80 so that rotation of the handle causes the piston rod to advance within the cylinder 60. The piston rod 80 may engage and drive a piston 90, which may be slidably disposed within the cylinder, to advance the piston therein. Installation of applicator head 14 into body 17 forms a product reservoir 101, between the piston 90 and generally the end or bottom of the head 40, and advancement of the piston may cause the enclosed volume of the reservoir to decrease, forcing product to be pumped therefrom.

Figure 6:
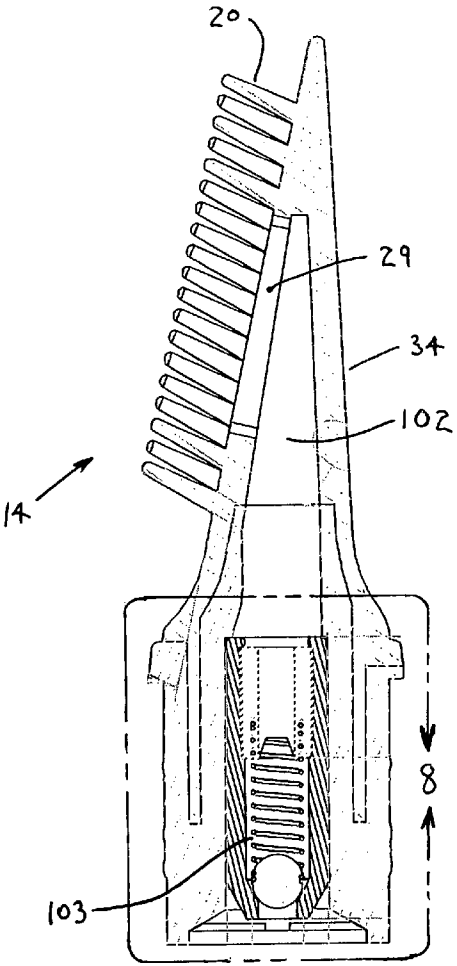
FIG. 6 is a cross-sectional view of the applicator head of FIG. 5.

The applicator head 14 may be installed into the body 17 through one of several different mechanical means, including a simple friction fit. In one embodiment, the applicator head 14 may be installed into, and retained within, body 17 by use of a friction fit. In another embodiment, the applicator head 14 may be threadably installed into body 17 by use of internal threading on the cylinder's upper internal surface 61, and use of external threading on the tubular extension 31 of the applicator head 14. In another embodiment, shown in FIGS. 5 and 6, the applicator head 14 may be snapped into cylinder 60 of the body 17. The snap-in arrangement may be accommodated by having one or more annular protrusions 32 on the tubular extension 31 of the applicator head 14, and corresponding annular indentations or recesses on the cylinder's upper internal surface 61. Alternatively, the indentations may be formed on the applicator head 14, while the annular protrusions are formed on the cylinder's upper internal surface 61. Any of these installation means for the applicator head 14 may be adapted to permit removal of the head and allow interchangeability of one applicator head in favor of another, possibly wider head. Alternatively, the applicator head 14 may be securely and permanently attached to the body 17, which may serve to preserve the integrity of the product contained therein, and reduce or eliminate the possibility of contamination.

Figure 8:
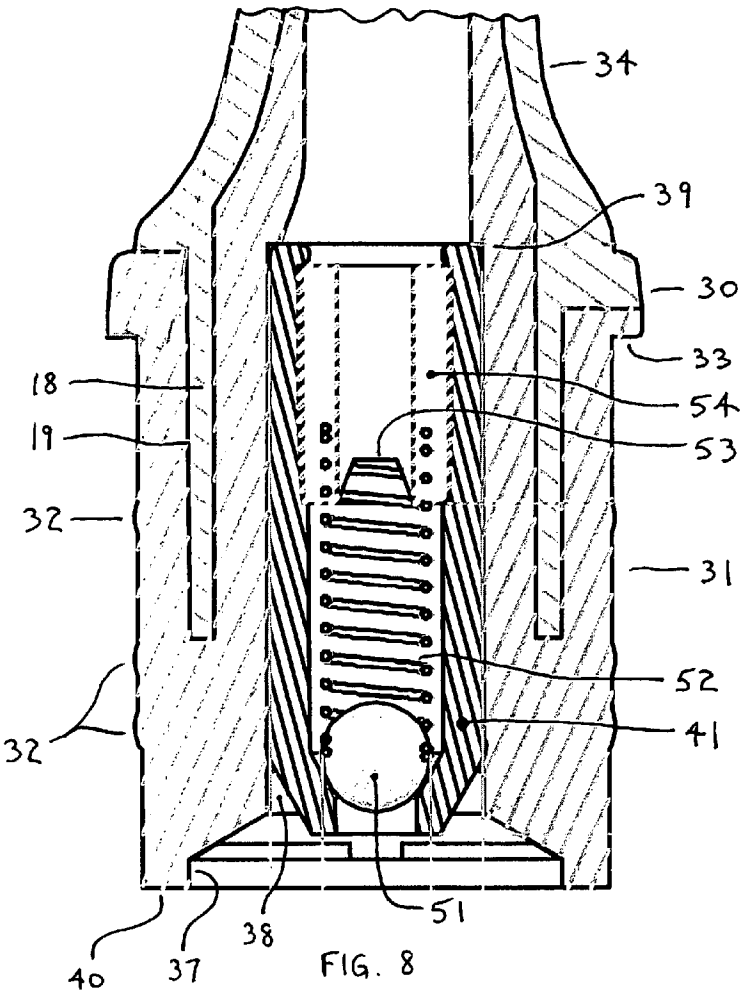
FIG. 8 is the cross-sectional view of FIG. 7, being enlarged to show the valve portion details.
Figure 12:
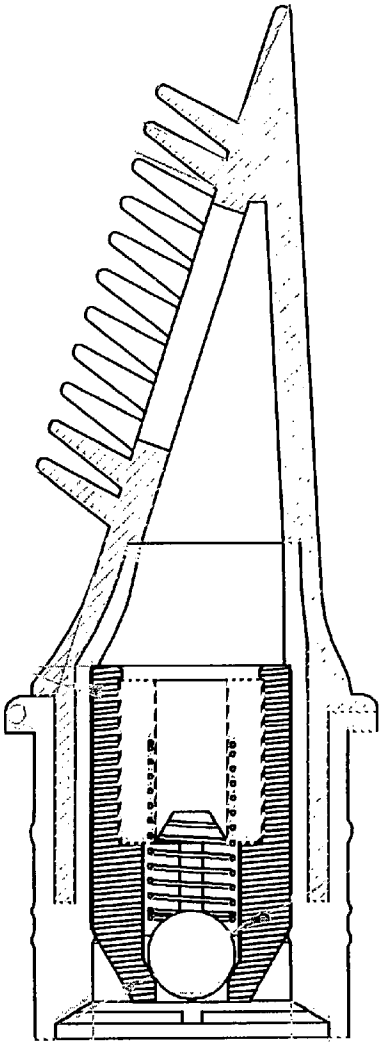
FIG. 12 is a cross-sectional view of the second embodiment of the applicator head of the present invention.

The applicator head 14 of the current invention may comprise a tubular extension 31 originating from an annular pedestal 30 (FIG. 8). The pedestal 30 may overhang the tubular extension 31 so as to form a shoulder 33. Installation of the applicator head 14 may occur with the tubular extension 31 being mated with the cylinder's upper internal surface 61 (FIG. 4) until shoulder 33 of the applicator head 14 reaches the end wall 62 of cylinder 60. An o-ring seal may be accommodated at the meeting of shoulder 33 and end wall 62 of cylinder 60, or may be accommodated where tubular extension 31 mates with the cylinder's upper internal surface 61.

Extending upward from pedestal 30 may be a V-shaped neck 34. The V-shaped neck 34 and tubular extension 31 may be formed as a single housing, or may be separately formed and then be mated together using male and female connectors 18 and 19 on respective parts (FIG. 8). Pedestal 30 may be integral to either the V-shaped neck 34 or tubular extension 31. The tubular extension 31 may include a cylindrical opening 38 beginning on the bottom surface 40—a first end of the housing—and may interconnect with an opening at a second end of the housing to form a conduit. Where the cylindrical opening 38 begins on surface 40, there may also be a countersunk opening 37 to transition between the cylindrical opening 38 and the flat surface 40.

Figure 9:
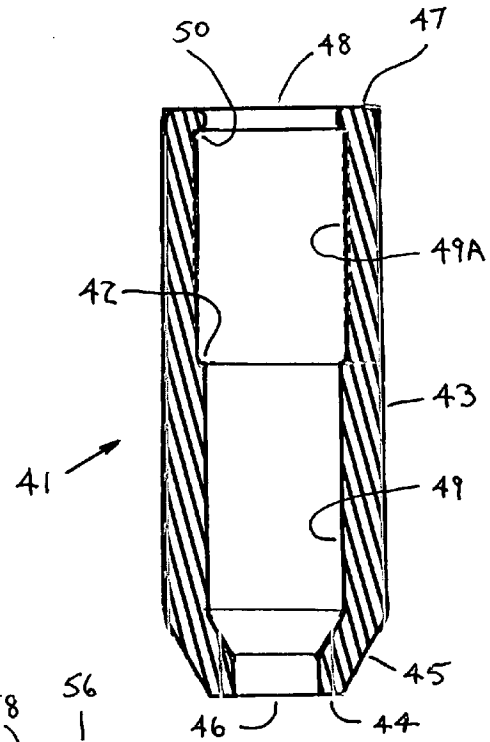
FIG. 9 is an enlarged cross-sectional view of the valve cylinder of the first embodiment of the applicator head of the present invention.
Figure 10:
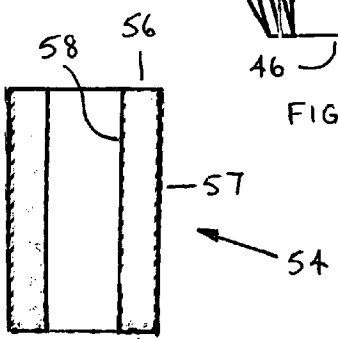
FIG. 10 is an enlarged cross-sectional view of the cylinder member of the first embodiment of the applicator head of the present invention.

Inserted into cylindrical opening 38 to occupy at least a portion of the conduit may be a valve cylinder 41. The portion of the conduit beyond the valve cylinder may comprise a product dispensing chamber 102. Where the cylindrical opening 38 transitions into the product dispensing chamber 102, within the V-shaped neck 34, a lip 39 may be formed to retain the valve cylinder. Valve cylinder 41 being installed therein may generally comprise a cylindrical outer wall 43 having a first end 44 and a second end 47 (FIG. 9). The first end 44 may have a tapered surface 45 between the cylindrical outer wall 43 and the first end 44. The first end may also have an opening 46 into an inner wall 49, which may be parallel to the outer wall 43 and taper 45. The inner wall 49 may transition to a second inner wall 49A having a greater diameter than inner wall 49, and create a first lip 42. An opening 48 in the second end 47 may create a second lip 50 at the second end 47 of the valve cylinder 41.

The valve cylinder 41 may be inserted into the cylindrical opening 38 of tubular extension 31 as seen in FIG. 8, which may interconnect to at least one opening at a second end of the housing to form a conduit. The first end 48 of the valve cylinder 41 may be flush with the end 39 of cylindrical opening 38. The external diameter of outer wall 43 and the internal diameter of cylindrical opening 38 may be sized so as to be engaged in an interference fit (friction fit) rather than a clearance fit, whereby the valve cylinder 41 may be inserted through either a press-fit installation process or a cryogenic installation process. The interference fit would serve to positively retain the valve cylinder 41 within the cylindrical opening 38.

Within the valve cylinder 41 may be cylindrical member 54, having a first end 55, a second end 56, an outer wall 57, and an inner wall 58. The cylindrical member 54 may be positioned within the valve cylinder 41 between the first lip 42 and second lip 50. A spherical valve ball 51 may be disposed within the valve cylinder 41, as seen in FIG. 8, and be biased by a coil spring 52 to normally block the opening 46 of the valve cylinder 41. The spring 52 may also bias a plug 53, which may be partially disposed within the first opening 55 of the cylindrical member 54, creating a valve cylinder product pool 103. The ball 51 and plug 53 may selectively block or close off the flow of product through the valve cylinder 41, so that valve cylinder product pool 103 may operate as an intermediate pooling area, to serve in maintaining product integrity within the reservoir 101. This may be accomplished by providing separation between the product reservoir 101 and the product dispensing chamber 102, which may be necessary because the application process, as discussed hereinafter, may cause contamination to enter the product dispensing chamber during application of product onto a receiving surface, which could propagate back towards the product reservoir. The valve cylinder product pool 103, in conjunction with the selective blocking of the valve cylinder, serves to reduce or eliminate the possibility of such contamination.

By twisting the handle 70, the mechanical connection with the piston rod 80 drives the piston 90, which in turn forces product contained within the product reservoir 101 through the spherical ball valve 51 and into the valve cylinder product pool 103, whereby movement of the plug permits product contained within the valve cylinder product pool 103 to flow into the product dispensing chamber 102 within the V-shaped neck 34. The valve arrangement serves to isolate the product within the product reservoir 101 and maintain its integrity, so there can be no back-flow of product which could cause contamination by matter acquired from the receiving surface. Moreover, the valve arrangement, also serves as a barrier to keep air from entering the chamber, and thus serves to maintain product moisture and consistency, and eliminate airborne contamination in the form of dust, pet dander, mold, pollen, bacteria, etc.

Figure 7:
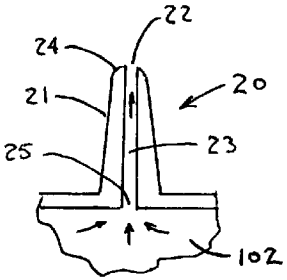
FIG. 7 is a cross-sectional view of an alternate nozzle embodiment of the applicator head of FIG. 5.

The V-shaped neck 34 may have a flat face 36 (a second end of the housing) that terminates in a tip 35. Protruding from the flat face 36 may be a plurality of prongs 20. In a first embodiment, the prongs may comprise a conical outer surface 21 which, as seen in FIG. 7, may protrude outward from the flat face 36 to end in a curved tip 24. The prongs 20 may each have a conduit 23 having one end interconnected to the product dispensing chamber 102 through an inlet 25. Product may thus flow from the product dispensing chamber 102 through inlet 25 of the prong 20, and out the exit orifice 22 at the curved tip 24 for delivery onto a surface. The conduit 23 may be sized in accordance with the viscosity of the product being delivered to accommodate a suitable flow rate. With the plurality of prongs 20 thus arranged, product may be dispensed to a broad area but with precision.

Figure 16:
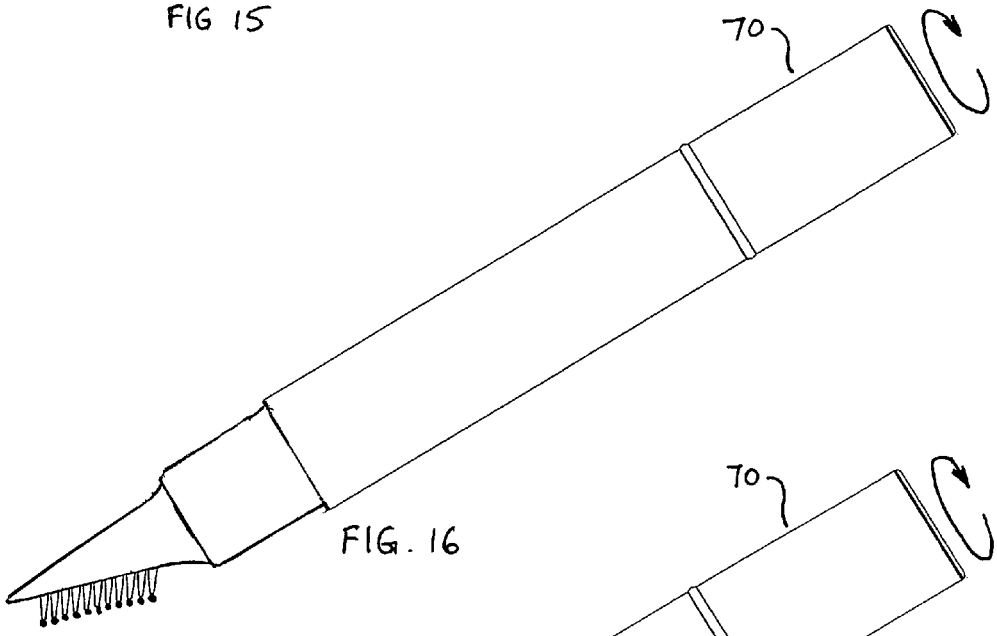
FIG. 16 is side view of the applicator of the present invention shown dispensing droplets of product from the nozzles.
Figure 17:
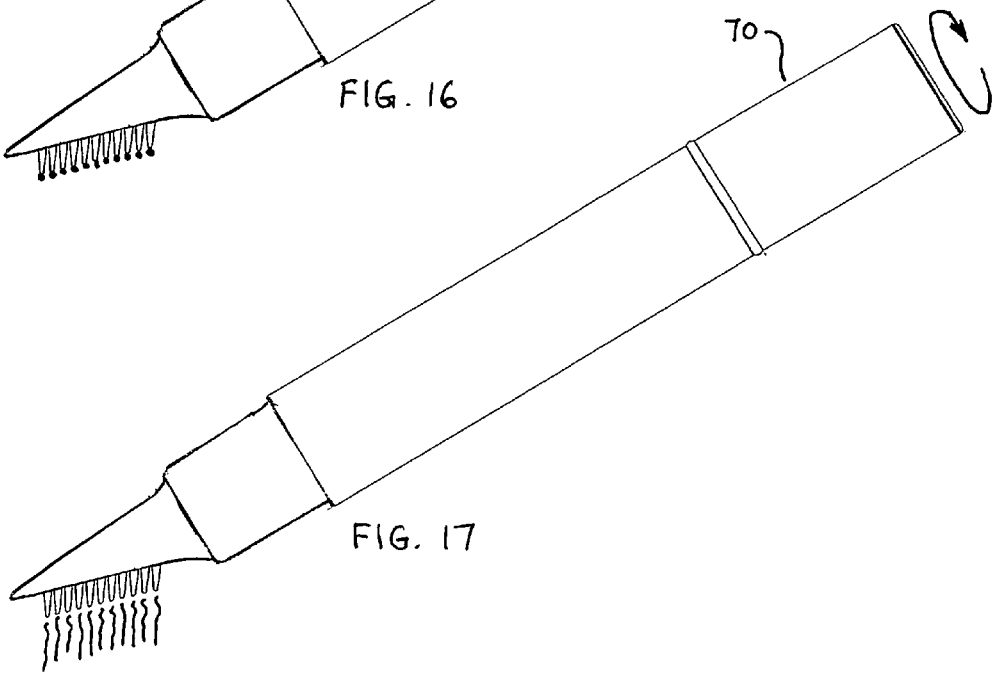
FIG. 17 is side view of the applicator of the present invention shown dispensing a stream of product from the nozzles.

The prongs may be manufactured from any suitable material. Material selection may be dictated by the particular application. Where the applicator may be used to dispense make-up products such as mascara, the nozzle may be made from materials including, but not limited to a thermo plastic elastomer (TPE). With the prongs so constructed, product may be dispensed with a careful turn of the handle 70 to merely bead product on the tip 24 of the nozzle for careful application, as in FIG. 16, or with a greater rotation of the handle 70, product may squirt from the prongs as in FIG. 17. The threading on the handle 70 and on the piston rod 80 may be of such a pitch to produce the appropriate degree of either coarse or fine movement of the piston, to result in a corresponding amount of product delivery.

Figure 5:
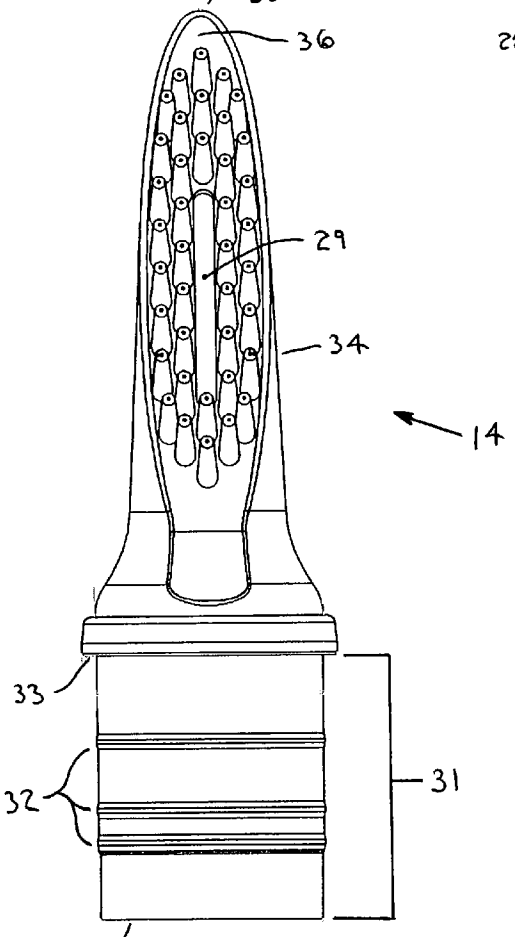
FIG. 5 is a front view of one embodiment of the applicator head of the present invention.
Figure 6A:
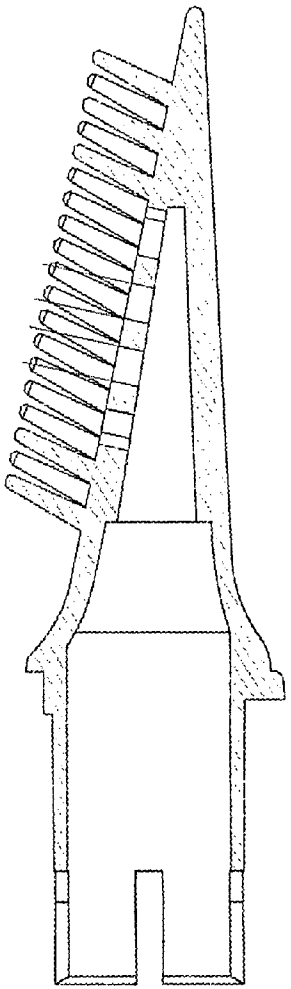
FIG. 6A is a cross-sectional view of the alternate embodiment in FIG. 6.
Figure 11:
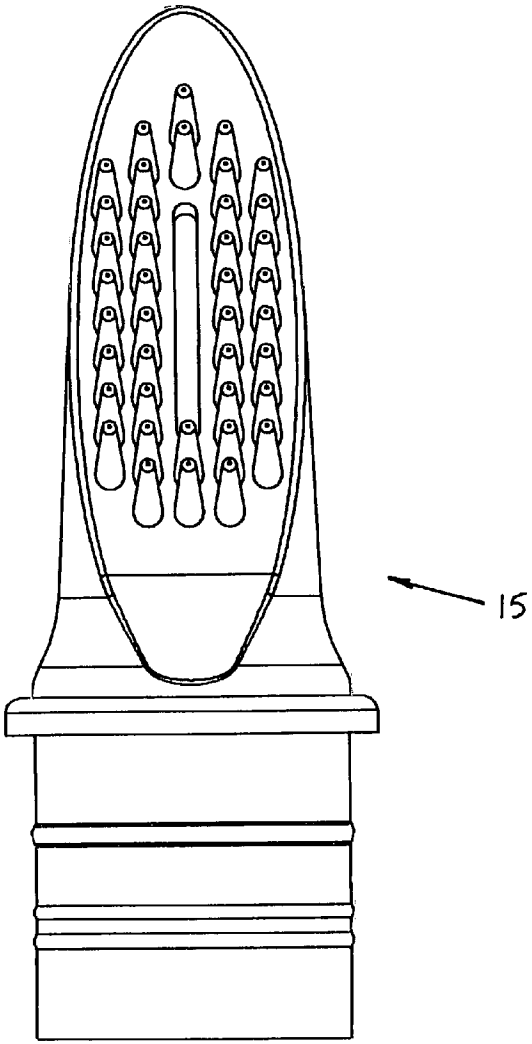
FIG. 11 is a front view of a second embodiment of the applicator head of the present invention.
Figure 13:
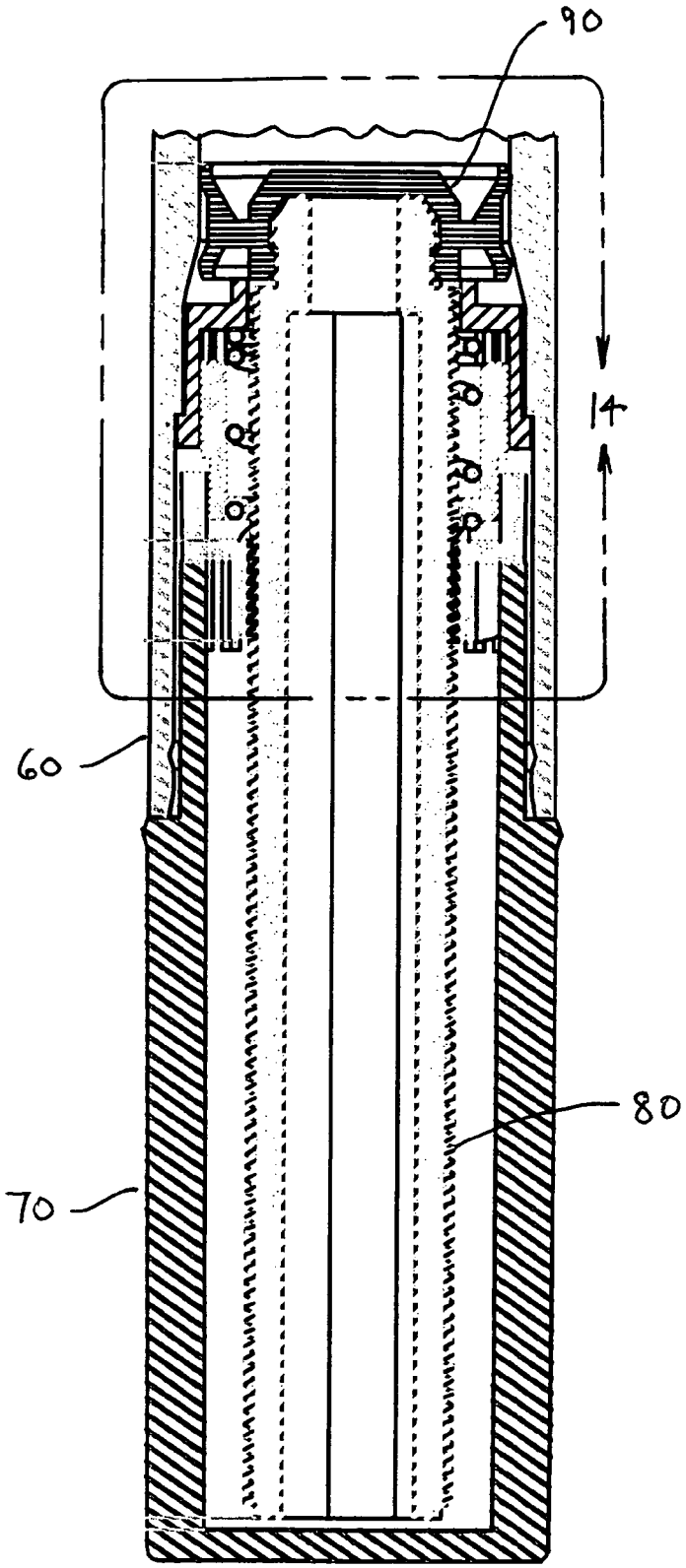
FIG. 13 is an enlarged cross-sectional view of the base portion of a first embodiment of the applicator of the present invention.
Figure 14:
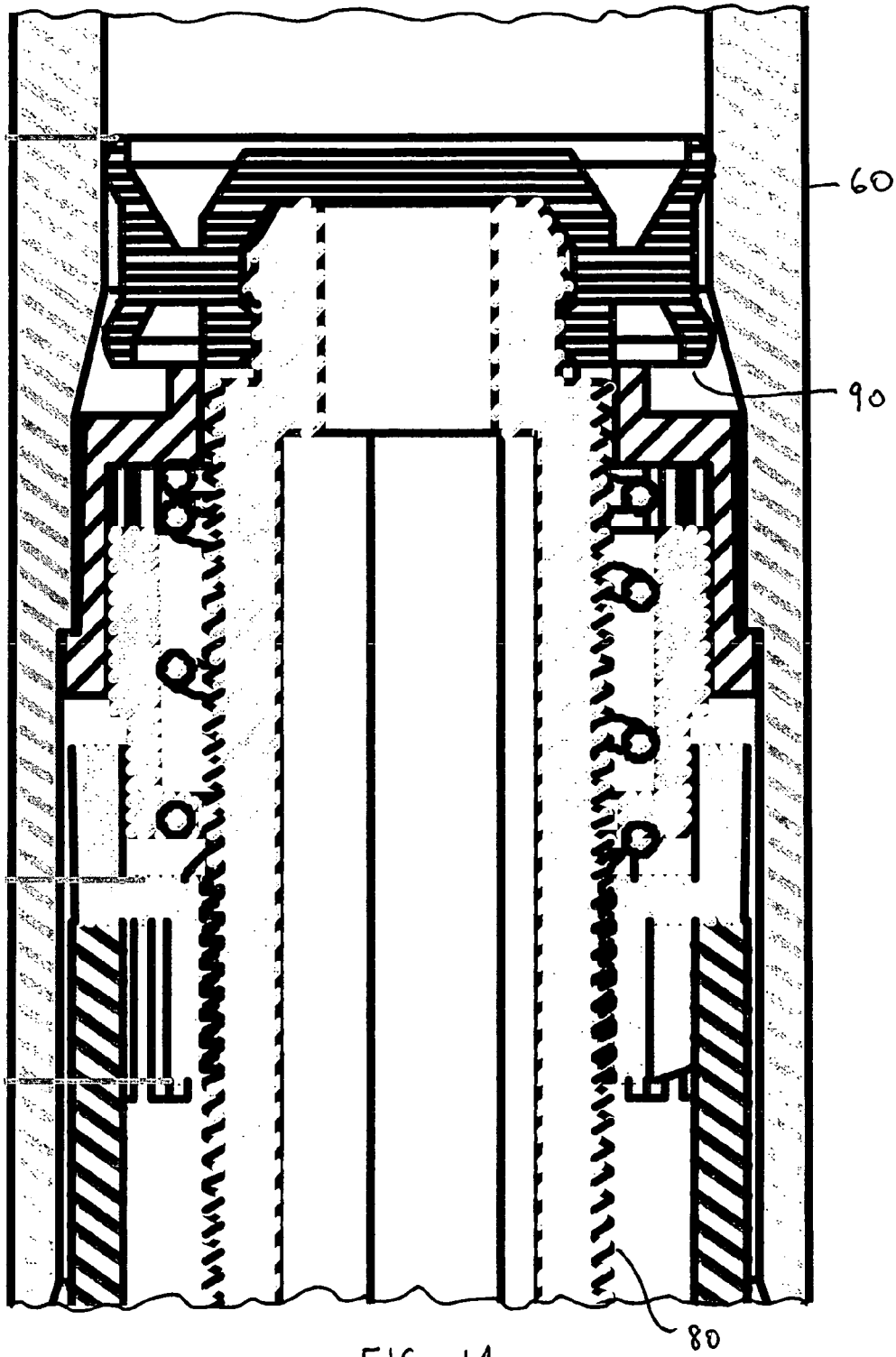
FIG. 14 is an enlarged cross-sectional view of the adjustment portion of the base of a first embodiment of the applicator of the present invention.
Figure 15:
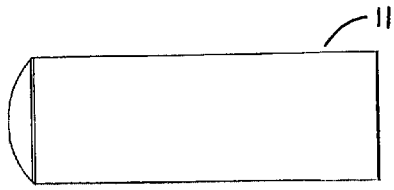
FIG. 15 is a side view of the cap of the first embodiment of the applicator of the present invention.

In a second embodiment, the conical prongs 20 may not be formed with conduit 23 and could therefore be solid. As seen in FIGS. 5 and 11, the conical prongs 20 may surround a single elongated opening 29 in the flat face 36, or alternatively, the prongs may surround multiple openings, such as the openings 29A, 29B, 29C, and 29D seen in FIG. 5A for head 14A. The elongated opening 29 or openings 29A-29D may directly interconnect to the dispensing chamber 102. The length of each of the one or more openings 29 and the total number of prongs may vary, and may be adjusted for a particular application. The density of prongs for a given area on the flat face 36 may also vary for a particular application, as seen in the applicator head 15 in FIG. 11. The width of the elongated opening 29 or openings 29A-29D may be greater or less than that shown in FIG. 5 and FIG. 11 to accommodate products having greater or lesser viscosities.

Figure 2:
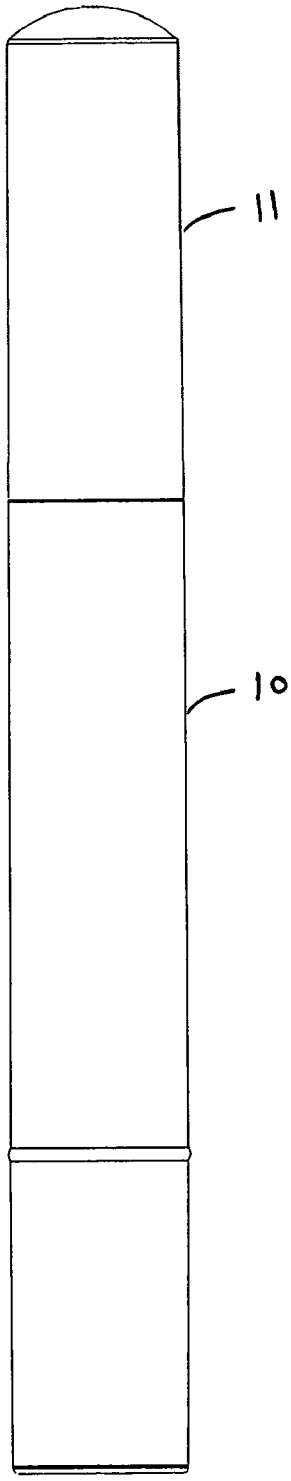
FIG. 2 is a side view of the first embodiment of FIG. 1.
Figure 2A:
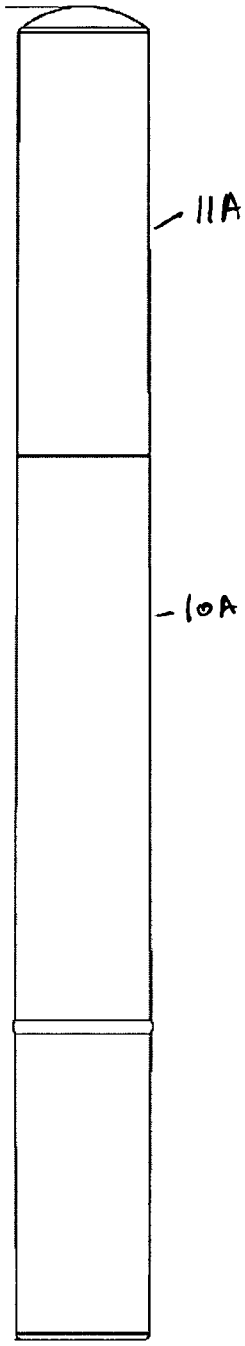
FIG. 2A is a side view of the alternate embodiment of FIG. 2A.
Figure 2B:
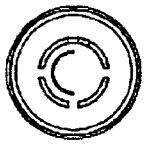
FIG. 2B is a bottom view of the embodiment of FIG. 2A.

As seen in FIGS. 1-2, a cap 11 may be snapped onto the applicator head to protect product contained within the product dispensing chamber applicator against contamination. The snapping of the cap may be using any of the mechanical attachment means discussed previously-receiving the cap onto the head in a friction fit; or snapping the cap onto the head using an annular protrusion being received in an annular recess. Additionally, as seen in FIGS. 1A-2A, a cap 11A may be threadably receiving onto said applicator head, to provide an air-tight seal. Also, the caps 11 or 11A may comprise an insert, where the insert serves to wipe the prongs during placement and/or removal of the cap from said applicator head.

Figure 1A:
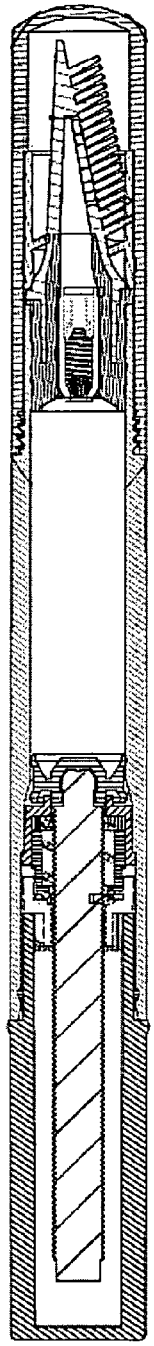
FIG. 1A is a cross-sectional view of an alternate embodiment of the applicator and cap of the present invention.
Figure 1B:
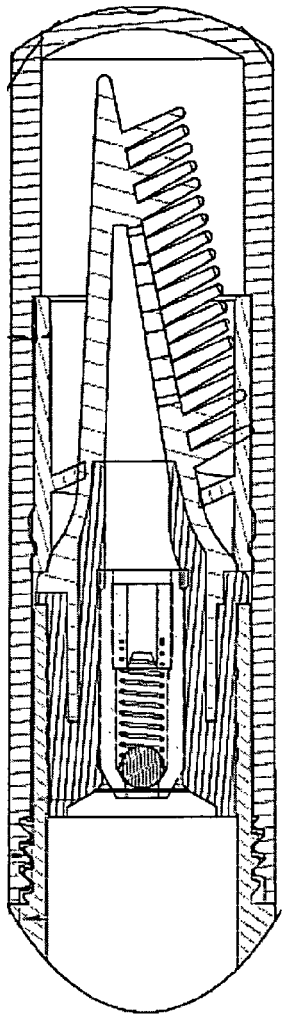
FIG. 1B is the view of FIG. 1A enlarged to show details of the wipe and cap threading.
Figure 1C:
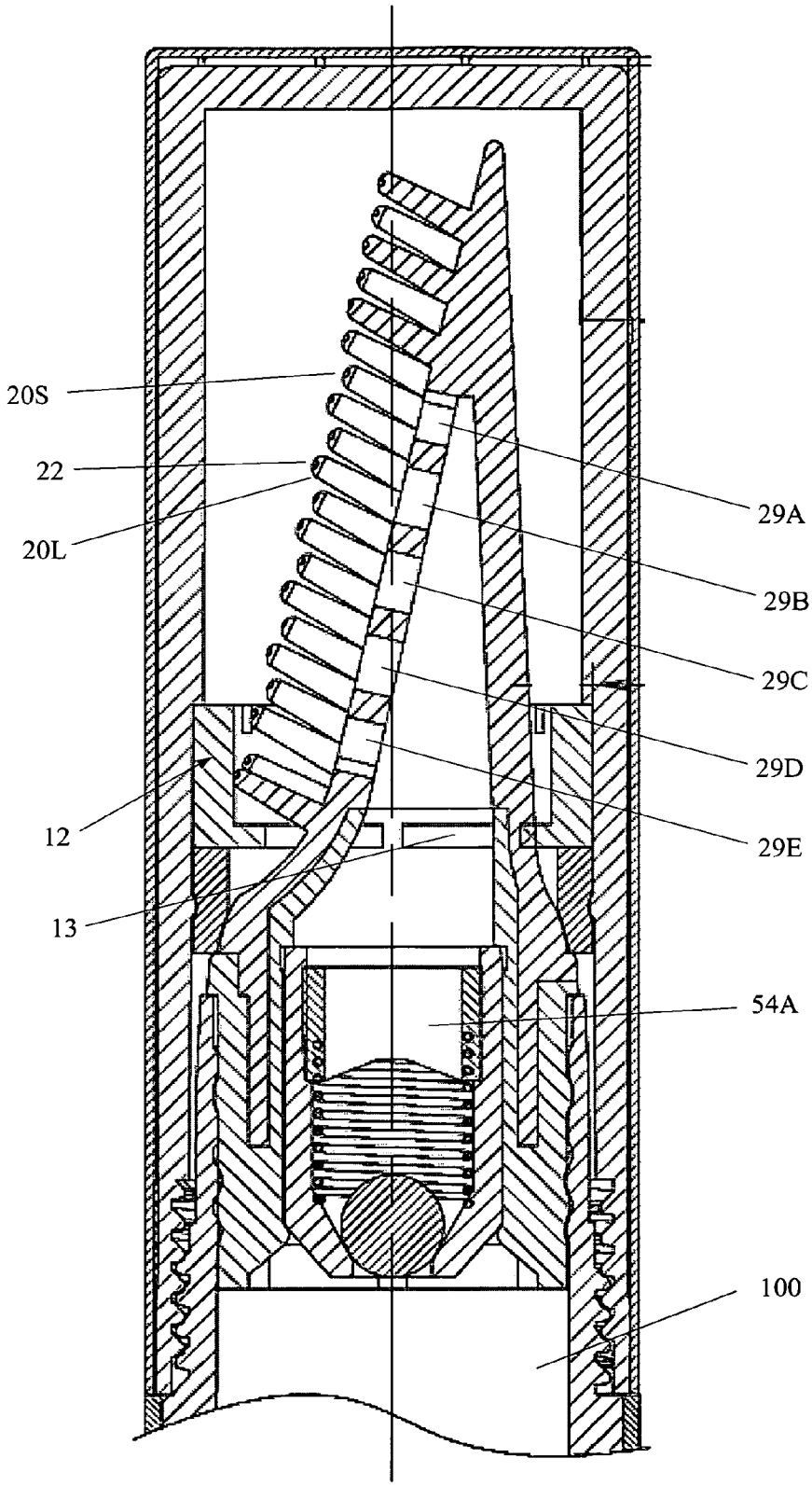
FIG. 1C is an alternate embodiment of the head and cap of FIG. 1B.
Figure 5A:
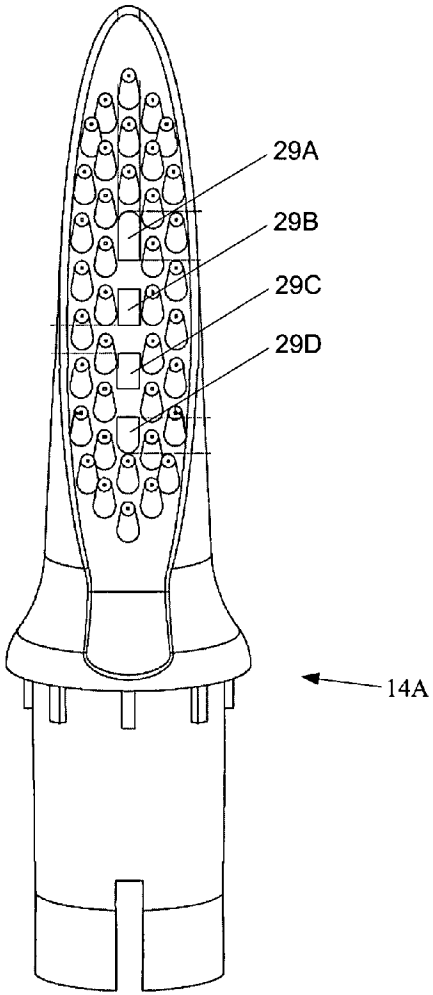
FIG. 5A is a front view of an alternate embodiment of the applicator head.

In yet another embodiment, seen in FIG. 1C, a plug 53 is not utilized, and a cylindrical member 54A may be open so that Product Dispensing Chamber 102 and Valve Cylinder Product Pool 103 merge to form single reservoir, which is nonetheless still separated from the Product Reservoir 101 by the spring loading of a spherical ball valve. In this embodiment, a critical difference is in the conical prongs used to apply the mascara. There may preferably be an alternating series of longer and shorter prongs, 20L and 20S, that extend away from the flat face 36, and which serve to aid a user in applying the mascara, by permitting the longer prongs to initially contact and possibly deflect a portion of the user's lashes, while the adjacent shorter prongs 20S follow and serve to better apply mascara to the inside surfaces of the exposed lashes, which may be a difficult to reach portion of the lash. In this embodiment, there may also be conduits 23 through the prongs permitting an additional flow of mascara product from the exit orifice 22 of the prongs, which advantageously serves to better apply mascara to the top and bottom of lashes—a very difficult to reach area with conventional mascara brush applicators. The difference in height of the prongs may preferably be at least 0.030 inches to permit the longer prongs to contact one or more lashes and cause deflection before the shorter prongs contact the un-deflected lashes. The height difference may preferably be not much more than 0.060 inches, otherwise the amount of displacement of the longer prongs 20L may be such that some of the deflected lashes may spring back to their initial position. There may be at least a single row of the alternating series of prongs disposed about each side of a plurality of openings 29A-29E (in the case of five openings, as seen in FIG. 1C), or there may be, as seen in FIG. 5A, two or more rows of prongs disposed about each side of the plurality of openings. A long prong 20L may also be disposed between openings 29A and 29B, between 29B and 29C, and between openings 29C and 29D. The prongs may preferably be made of a thermoplastic elastomeric material. Where both conduits 23 in the prongs are used along with openings 29A . . . , the size of the openings (e.g., 29A-29E) may need to be smaller and be calibrated with the size of the conduits to ensure a proper amount of flow from each. If the openings 29A-29E were too large, this may result in insufficient pressure within the Product Dispensing Chamber 102 to force mascara product from the orifices 22 of the prongs 20. Also in this embodiment, a screw-on cap may also be used, and which contains an insert 12 that may be made of a flexible material that has a flange 13 that extends at least part-way across the opening of the cap, and thereby serves to wipe the prongs during placement on and/or removal of the cap from, the applicator head. This prevents agglomeration and drying of mascara product upon the prongs, which would degrade the fidelity with which the applicator may be used to apply mascara onto a person's lashes. While any excess product transferred to the insert may agglomerate thereon, such agglomeration would not serve to degrade application of product onto the user.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention as described in the following claims.

I claim:

1. An applicator device, for use in applying mascara, said device comprising:

a head; said head comprising:

a housing having a first end and a second end, said first end comprising an opening into a conduit, said second end of said housing comprising a V-shaped projection with one side of said V-shaped projection comprising an elongated and generally flat surface, said generally flat surface comprising a plurality of openings formed to interconnect with said conduit, said plurality of openings being in-line with said elongated flat surface and being regularly spaced apart;

a valve cylinder; said valve cylinder being received into a portion of said conduit at said housing first end; said valve cylinder having at least a first end being selectively blocked to form a pooling area within said valve cylinder; said portion of said conduit beyond said valve cylinder forming a product dispensing chamber; and a plurality of conical prongs being secured to and extending away from said elongated flat surface of said V-shaped projection at said second end of said housing, said plurality of conical prongs comprising a first prong type and a second prong type, said first prong type extending a first distance away from said elongated flat surface, and said second prong type extending a second distance away from said elongated flat surface, said first distance being greater than said second distance, said prongs of said second type being disposed about said elongated flat surface so as to alternate between prongs of said first type; said plurality of openings in said housing being interspersed between two pairs of rows of said alternating first and second prong types;

and a body, said body being adapted to receive said head to form an enclosed volume forming a product reservoir; said body comprising a means for decreasing said volume of said product reservoir to pump product from said product reservoir through said pooling area of said valve cylinder and through said product dispensing chamber to be delivered out from said plurality of openings at said housing second end; said pooling area being adapted to maintain product integrity within said product reservoir by separation from said product dispensing chamber.

2. The applicator device of claim 1, wherein each of said plurality of openings comprises an elongated opening.

3. The applicator device of claim 2, wherein a length and a width of each of said plurality of openings in said elongated flat surface on said V-shaped projection is adapted for a viscosity of the mascara being dispensed therefrom.

4. The applicator device of claim 1, wherein said selective blocking of said valve cylinder is by a spherical ball disposed within said cylinder, said spherical ball being spring biased to normally block said first end of said valve cylinder.

5. The applicator device of claim 1, wherein said first distance of said first prong type is greater than said second distance of said second prong type by an amount in the range of 0.030 inches to 0.060 inches.

6. The applicator device of claim 1, wherein said applicator head is fixedly received in said body by a mechanical means.

7. The applicator device of claim 1, wherein said applicator head is removably received in said body to permit said head to be interchanged with a different head.

8. The applicator device of claim 1, further comprising a cap, said cap being releasably securable to said applicator head.

9. The applicator device of claim 8, wherein said releasable securing of said cap to said applicator head comprises a mechanical attachment being from the group of mechanical attachments consisting of threadably receiving said cap onto said applicator head; receiving said cap onto said head in a friction fit; or snapping said cap onto said head using an annular protrusion being received in an annular recess.

10. The applicator device of claim 9, wherein said cap is adapted to provide an air-tight seal.

11. The applicator device of claim 10, wherein said cap comprises an insert, said insert being adapted to wipe said prongs during removal of said cap from said applicator head and during said securing of said cap on said applicator head.

12. The applicator device of claim 6, wherein said body comprises a cylinder having a first end and a second end, said second end receiving said head.

13. An applicator device, for use in applying mascara, said device comprising:

a head; said head comprising:

a housing having a first end and a second end, said first end comprising an opening into a conduit, said second end of said housing comprising a V-shaped projection with one side of said V-shaped projection comprising an elongated and generally flat surface, said generally flat surface comprising a plurality of openings formed to interconnect with said conduit, said plurality of openings being in-line with said elongated flat surface and being regularly spaced apart;

a valve cylinder; said valve cylinder being received into a portion of said conduit at said housing first end; said valve cylinder having at least a first end being selectively blocked to form a pooling area within said valve cylinder; said portion of said conduit beyond said valve cylinder forming a product dispensing chamber; and a plurality of conical prongs being secured to and extending away from said elongated flat surface of said V-shaped projection at said second end of said housing, said plurality of conical prongs comprising a first prong type and a second prong type; said first prong type extending a first distance away from said elongated flat surface, and said second prong type extending a second distance away from said elongated flat surface, said first distance being greater than said second distance, said prongs of said second type being disposed about said elongated flat surface so as to alternate between prongs of said first type; said plurality of openings in said housing being interspersed between two pairs of rows of said alternating first and second prong types;

and a body, said body being adapted to receive said head to form an enclosed volume forming a product reservoir; said body comprising a movable piston for decreasing said volume of said product reservoir to pump product from said product reservoir through said pooling area of said valve cylinder and through said product dispensing chamber to be delivered out from said plurality of openings at said housing second end; said pooling area being adapted to maintain product integrity within said product reservoir by separation from said product dispensing chamber.

14. The applicator device of claim 13, wherein each of said plurality of openings comprises an elongated opening.

15. The applicator device of claim 14, wherein a length and a width of each of said plurality of openings in said elongated flat surface on said V-shaped projection is adapted for a viscosity of the mascara being dispensed therefrom.

16. The applicator device of claim 15, wherein said selective blocking of said valve cylinder is by a spherical ball disposed within said cylinder, said spherical ball being spring biased to normally block said first end of said valve cylinder.

17. The applicator device of claim 16, wherein said first distance of said first prong type is greater than said second distance of said second prong type by an amount in the range of 0.030 inches to 0.060 inches.

18. The applicator device of claim 17, wherein said body comprises a cylinder having a first end and a second end, said second receiving said head; and wherein said piston is slidably disposed within said cylinder between said first end of said cylinder and said applicator head to thereby create said product reservoir.

19. The applicator device of claim 18, further comprising:

a handle, said handle being rotatably received at said first end of said cylinder; and a piston rod, said piston rod being threadably engaged by said handle wherein rotation of said handle relative to said cylinder causes said piston rod to translate relative to said cylinder and drive said piston toward said cylinder second end to thereby decrease said volume of said product reservoir.

* * * * *